US012709963B2

(12) United States Patent
Churchill

(10) Patent No.: US 12,709,963 B2
(45) Date of Patent: Aug. 18, 2026

(54) CLEANING TOOL AND METHOD

(71) Applicant: CORETRAX GLOBAL LIMITED, Aberdeen (GB)

(72) Inventor: Andrew Philip Churchill, Dubai (AE)

(73) Assignee: Cortrax Global Limited, Aberdeen (GB)

( * ) Notice: Subject to any disclaimer, the term of this patent is extended or adjusted under 35 U.S.C. 154(b) by 870 days.

(21) Appl. No.: 17/907,957

(22) PCT Filed: Mar. 1, 2021

(86) PCT No.: PCT/EP2021/025082

§ 371 (c)(1),
(2) Date: Aug. 29, 2022

(87) PCT Pub. No.: WO2021/170299

PCT Pub. Date: Sep. 2, 2021

(65) Prior Publication Data

US 2023/0125332 A1 Apr. 27, 2023

(30) Foreign Application Priority Data

Feb. 27, 2020 (GB) ..... 2002820

(51) Int. Cl.

| | |
|---|---|
| ***E21B 37/02*** | (2006.01) |
| ***E21B 37/00*** | (2006.01) |
| ***E21B 41/00*** | (2006.01) |

(52) U.S. Cl.

CPC ..... *E21B 41/0078* (2013.01); *E21B 37/00* (2013.01); *E21B 2200/06* (2020.05)

(58) Field of Classification Search

None

See application file for complete search history.

(56) References Cited

U.S. PATENT DOCUMENTS

| | | | | |
|---|---|---|---|---|
| 5,960,881 | A * | 10/1999 | Allamon | E21B 34/142 166/70 |
| 6,289,987 | B1 | 9/2001 | Lay, Jr. | |
| 2006/0207796 | A1 | 9/2006 | Stewart | |
| 2006/0219441 | A1* | 10/2006 | Telfer | E21B 37/00 175/325.7 |
| 2018/0334880 | A1* | 11/2018 | Jones | E21B 33/134 |

FOREIGN PATENT DOCUMENTS

| | | |
|---|---|---|
| WO | 2004097163 | 11/2004 |

OTHER PUBLICATIONS

International Search Report for Application No. PCT/EP2021/025082 dated Apr. 21, 2021. 3 pages.
International Written Opinion for Application No. PCT/EP2021/025082 dated Apr. 21, 2021. 6 pages.

* cited by examiner

*Primary Examiner* — Eric W Golightly
(74) *Attorney, Agent, or Firm* — Patterson + Sheridan, LLP

(57) ABSTRACT

A downhole cleaning tool (40) adapted for location in bore-lining tubing (22). The tool (40) comprises a tubular body (42) defining an internal bore (48), at least one radially extending cleaning blade (92), and an external axially extending bypass flute (96, 98, 100, 102). The body further defines a fluid flow path from the internal bore (48) to at least one elongated jetting slot (94) extending along an outer surface of the blade (92).

14 Claims, 9 Drawing Sheets

CLEANING TOOL AND METHOD

FIELD

This disclosure relates to a cleaning tool and cleaning method, and to a hydraulic cleaning tool and method for cleaning tubing.

BACKGROUND

In the oil and gas exploration and production industry drilled bores are lined with metal tubing. The internal surfaces of the tubing may become contaminated with material, for example drill cuttings or cement residue. An operator may elect to clean the tubing, for example to provide a surface suitable for the creation of a seal with a packer or the like.

U.S. Pat. No. 10,458,204, the disclosure of which is incorporated herein in its entirety, describes a downhole tool comprising a body having a fluid inlet and a fluid outlet and configured to accelerate fluid flowing along a fluid flow path from the inlet to the outlet. The fluid outlet is configured to provide a radially directed and substantially circumferentially continuous stream of fluid. The stream of fluid may be used to clean or cut downhole tubing.

UK Patent GB2566249B describes a downhole tool comprising a tubular body having an axial through bore and adapted for connection within a work string. A sleeve is mounted around the body and includes helical stabiliser blades. The outer surfaces of the stabiliser blades include jetting ports to direct fluid from the through bore onto a surface of the well bore. Each jetting port includes a nozzle located at an exit of the jetting port. The nozzles reduce the diameter available for fluid flow and increase the velocity of the flow as it exits the tool.

SUMMARY

An aspect of this disclosure relates to a downhole cleaning tool for location in a bore, the tool comprising a tubular body defining an internal bore, at least one radially extending blade, and an external axially extending bypass flute, the body further defining a fluid flow path from the internal bore to at least one jetting slot extending along an outer surface of the blade.

Another aspect of the disclosure relates to a method of cleaning a surface of fluid-filled downhole tubing, the method comprising locating a cleaning tool with a tubular tool body within well fluid-filled downhole tubing, directing cleaning fluid from a bore of the tool body and through a jetting slot in a radially extending blade on an external surface of the tool body, and directing well fluid over the external surface of the tool body and around the blade via a bypass flute.

The provision of an external bypass flute facilitates displacement of fluid past the tool, facilitating passage of fluid past or around the blade and between the tool and a surrounding bore wall. The tool will be movable relative to the surrounding bore wall such that occlusion of the flute is unlikely, that is any material which gathers in the flute will likely be dislodged by relative movement of the tool.

In use, the jetting slot will tend to generate and direct a jet of fluid of corresponding form to the jetting slot, that is with an elongated cross-section which is relatively long and narrow. This line of spray may be advanced along the surface of the tubing to be cleaned as the tool is translated through the tubing. The creation of an elongated jet or line of spray may ensure that the area of the tubing surface traversed by the slot is contacted by a mass of fluid of consistent and predictable form, and thus the cleaning effect provided by the fluid will also be consistent and predictable. The jetting slot may be oriented to provide a jet of liquid substantially perpendicular to a main axis of the tool body or may provide a jet of liquid inclined to the axis or parallel to the axis.

The provision of the jetting slot in the blade facilitates location of the slot near the surface of the downhole tubing, such that fluid exiting the slot is more effective in cleaning the tubing. The fluid will exit the slot at very high velocity and impact against the tubing surface and dislodge material from the surface. As the slot opening and the outer surface of the blade are very close to the tubing surface, the fluid will maintain a high velocity as it flows along the tubing surface, away from the impact zone. The flow between the outer surface of the blade and the inner surface of the tubing will also be turbulent, thus providing a cleaning effect.

The slot may be provided in a first blade, such as a cleaning blade, with a first radial extent and a second blade, such as a stabiliser blade, may be provided with a second radial extent greater than the first radial extent. The second blade may thus ensure that the first blade, and thus the slot, is spaced from the surface of the downhole tubing by an appropriate distance. This minimises the risk of the flow of cleaning fluid damaging the surface of the downhole tubing, as might occur if the jetting slot was too close to the surface, or of the jetting slot being closed by contact with the surface. The second blade also offers a degree of protection for the first blade and slot by maintaining the first blade, and the slot, spaced from the surface of the tubing as the tool is translated through the tubing. The first and second blades may be integrated as a unitary blade, or the first blade may be axially or circumferentially spaced from the second blade. The second blade may be incorporated in the tool or may be provided in a separate tool. For example, the second blade may be provided by a conventional stabiliser located in a support string adjacent to the cleaning tool.

The slot may extend circumferentially around the body or may extend axially along the body. The slot may be inclined to a main axis of the body, for example the slot may extend helically along the body. A plurality of slots may be provided, and each slot may be associated with a respective blade, or a plurality of slots may be provided in a single blade.

The bypass flute may extend circumferentially of the tool body. For example, the bypass flute may extend helically or may extend axially and then extend circumferentially or may extended in a serpentine fashion.

A plurality of bypass flutes may be provided, and a plurality of slots may collectively extend around the entire circumference of the body. With such an arrangement axial translation of the tool will provide complete circumferential cleaning coverage from the lines of spray from each slot without requiring rotation of the tool.

In an initial tool configuration, the fluid flow path may be closed, such that other operations may be carried out with the tool in a dormant configuration. The flow path may be opened by any appropriate mechanism or arrangement. In one example flow ports in the tool body communicate with the tool internal bore. One of more internal sleeves or other valve members may initially close the flow ports. Axial displacement of the sleeve may open the flow ports. The sleeve may be displaced by landing a flow restriction, such as a ball or dart, in the sleeve such that a pressure differential may be created across the flow restriction. The tool internal bore may be at least partially occluded below the fluid flow path such that most or all the fluid passing down into the tool is directed through the slots. Partial occlusion, for example by a nozzled dart, permits a proportion of the fluid flow to continue to the end of the string and then flow up the annulus between the string and the surrounding tubing. Such a flow of fluid up the annulus facilitates entrainment of material dislodged from the tubing by the tool and carrying of the dislodged material to the surface. Other valve arrangements may be provided, for example burst discs or a valve that operates in response to a signal such as a pressure pulse, a signal emitted by an RFID tag, or a timer.

The tool body may comprise a primary tubular body and an external sleeve. The blade and the slot may be formed by the external sleeve. The sleeve may be a single part or may comprise a plurality of parts. A manifold may be provided between the primary tubular body and the sleeve. The manifold may be annular and may provide fluid communication between a plurality of flow ports in the primary tubular body and a plurality of spaced slots formed in the external sleeve. In other examples flow openings at the internal bore may communicate directly with jetting slots.

The tool may be adapted for mounting on or in a tubular support. For example, the tool may be adapted to be integrated into a work string formed of drill pipe.

The various features of the disclosure described above, and as set out in the appended claims, may be provided in combination but may also have utility when provided independently. For example, features of the tools described herein may be incorporated in tools provided with conventional circular jetting nozzles, rather than elongated slots.

BRIEF DESCRIPTION OF THE DRAWINGS

These and other aspects of the disclosure will now be described, by way of example, with reference to the accompanying drawings in which.

DETAILED DESCRIPTION OF THE DRAWINGS

Figure 1:
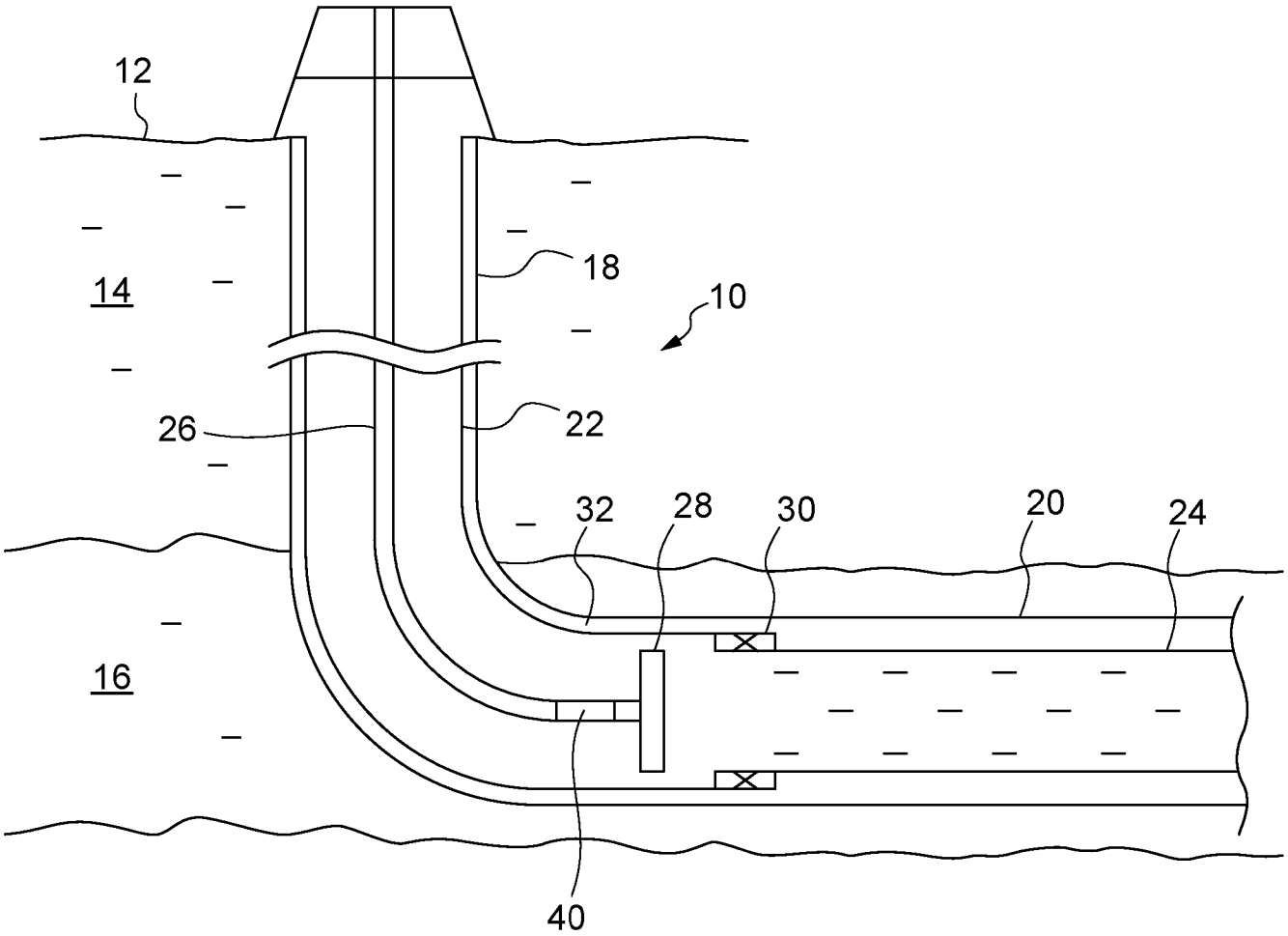
FIG. 1 is a schematic of a downhole operation using a cleaning tool in accordance with an aspect of the disclosure.
Figure 2:
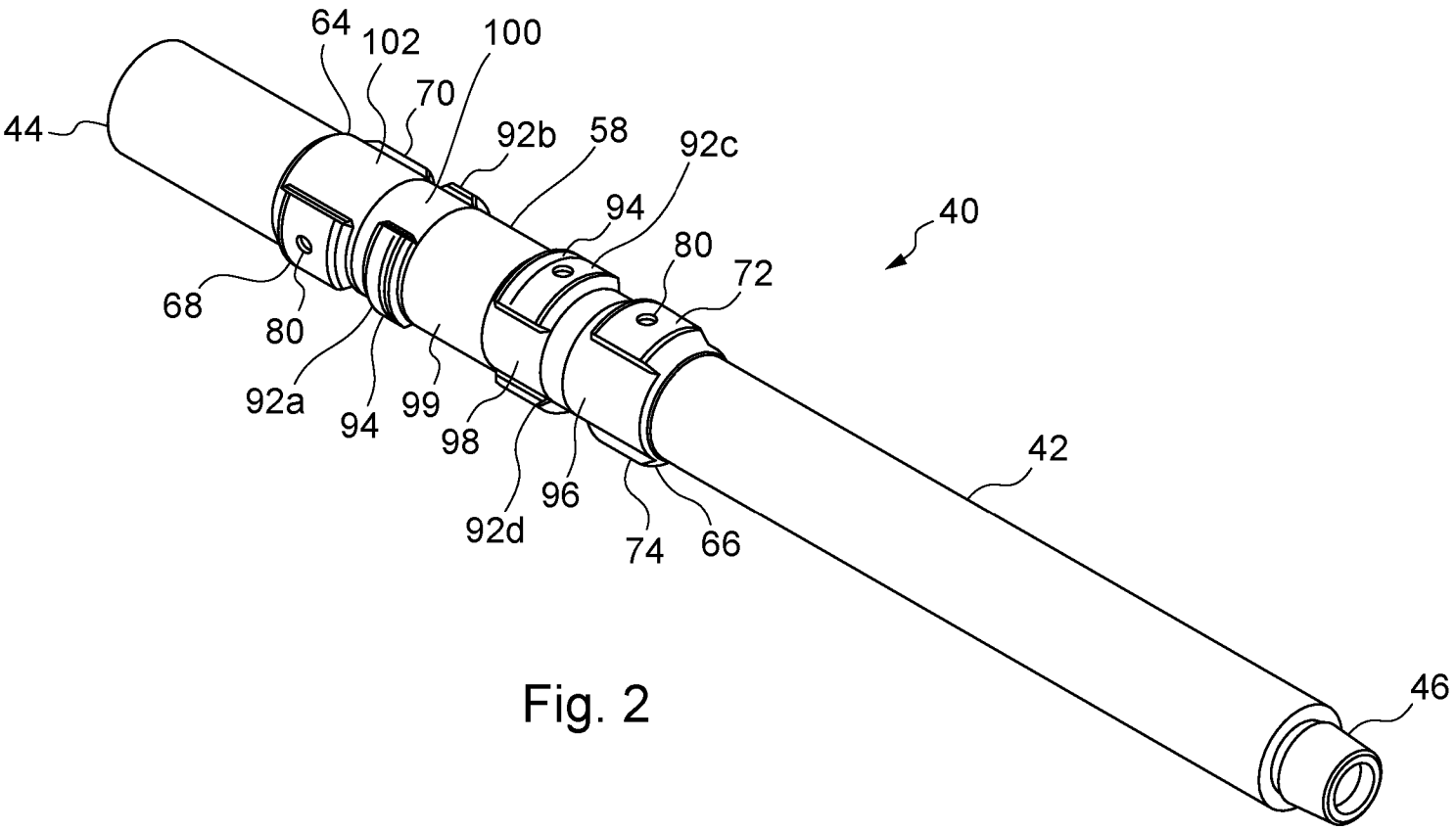
FIG. 2 is an enlarged isometric view of the cleaning tool of FIG. 1.
Figure 3:
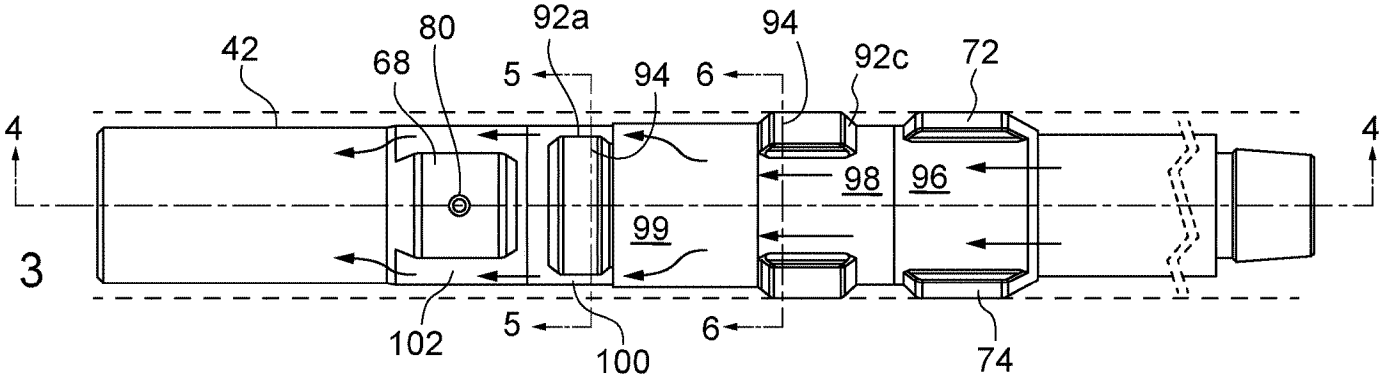
FIG. 3 is a side elevation of the cleaning tool of FIG. 2.
Figure 4:
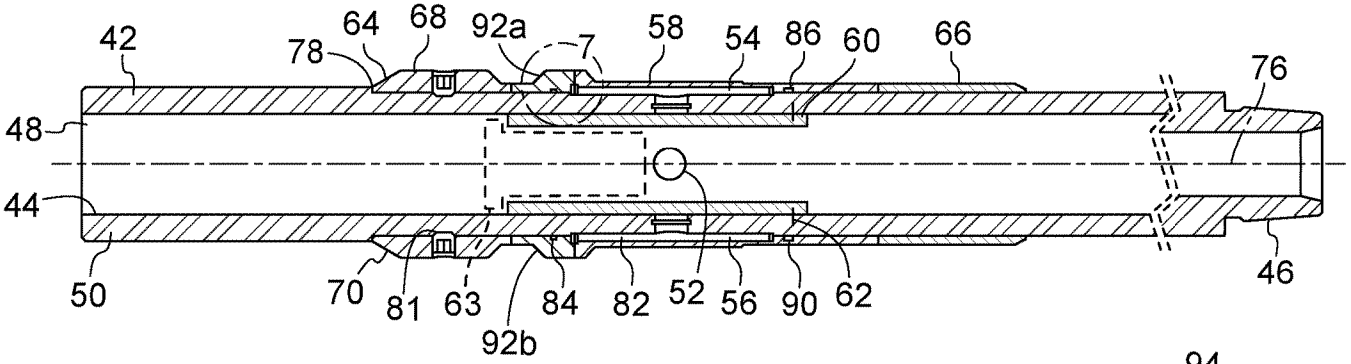
FIG. 4 is a sectional view on line 4-4 of FIG. 3.
Figure 6:
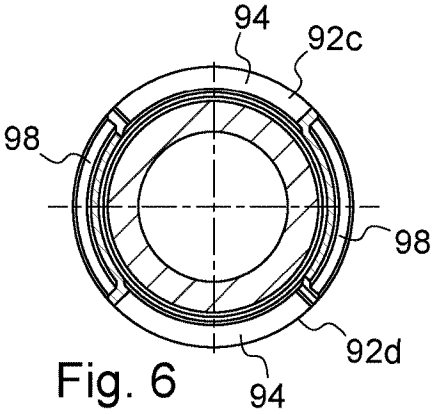
FIG. 6 is an enlarged sectional view of line 6-6 of FIG. 3.
Figure 7:
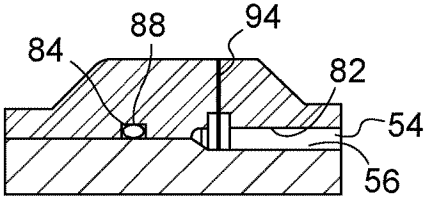
FIG. 7 is a further enlarged sectional view of detail 7 of FIG. 4.
Figure 5:
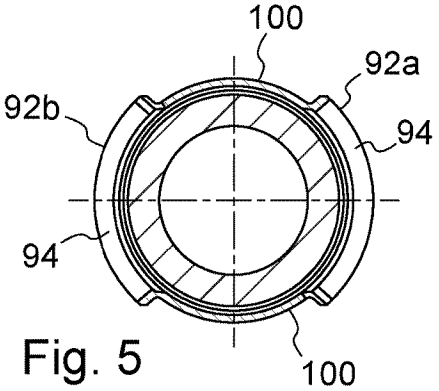
FIG. 5 is an enlarged sectional view on line 5-5 of FIG. 3.
Figure 8:
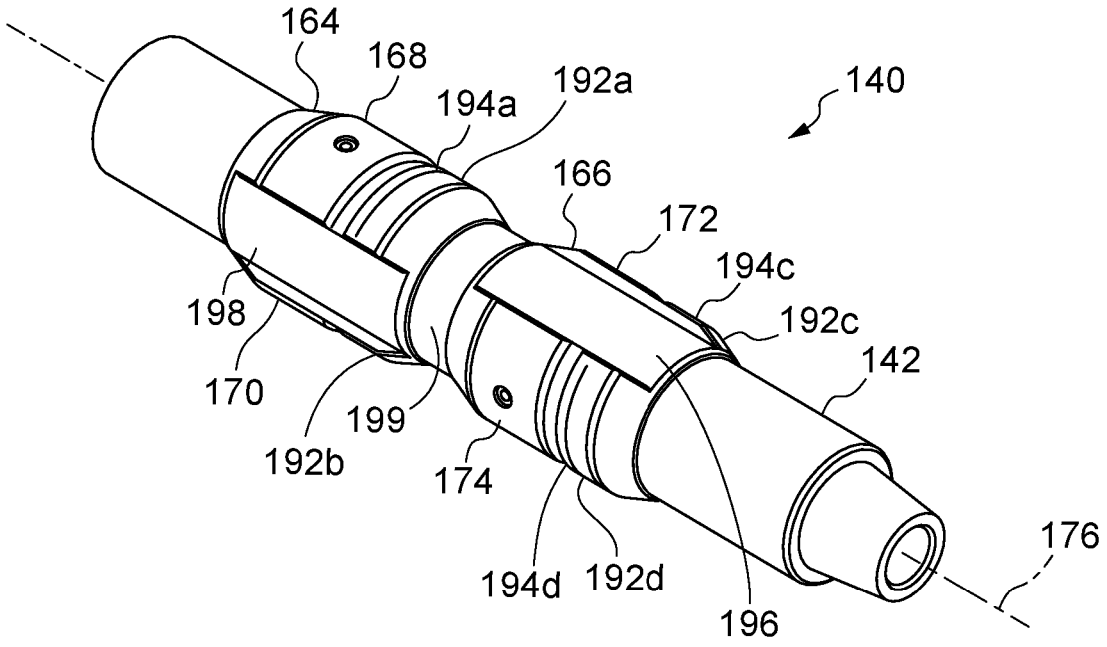
FIG. 8 is an isometric view of an alternative cleaning tool in accordance with an aspect of the disclosure.

Reference is first made to FIG. 1 of the drawings, a schematic of a downhole operation. The figure illustrates a well 10 that has been drilled from surface 12 through the earth 14 to access a subsurface hydrocarbon-bearing formation 16. The well 10 includes a substantially vertical section 18 and a substantially horizontal section 20. The vertical section 18 and a part of the horizontal section 20 has been lined with metal tubing in the form of casing 22. In practice, it is likely that multiple casing sections will be have been provided in the well, but for ease of illustration only a single casing 22 is shown. The casing 22 extends back to the surface 12.

The distal portion of the well is provided with a slotted liner 24 and FIG. 1 illustrates a step in the process of running the liner 24 into the well 10. In particular, the liner 24 has been run into the well supported from surface on a work string 26 and a running tool 28. A liner hanger 30 is provided at the upper or proximal end of the liner 24 and has been set to seal and secure the liner to the lower or distal end of the casing 22. After the hanger 30 is set the running tool 28 is disengaged from the liner 24 such that the running tool 28 and the work string 26 may be retrieved to surface.

In a subsequent operation a tubular string (not shown), referred to as a completion, will be extended into the liner 24 and will be used to carry hydrocarbons which flow into the horizontal well section 20 and through the slotted liner 24 to surface. The completion will be sealed and secured to an area 32 of the casing 22 above the proximal end of the liner 24. To facilitate provision of a high-quality seal the casing surface at the area 32 will be subject to cleaning. Conventionally the cleaning operation is achieved by running a scraper tool into the well 10 on a tool string and then mechanically scraping the casing surface. This requires a separate operation to be carried out between the retrieval of the liner-running work string 26 and the installation of the completion.

In this example of the present disclosure the requirement to separately run a scraping tool into the well is avoided. This is achieved by providing a cleaning tool 40 towards the lower or distal end of the work string 26. As will be described, the cleaning tool 40 may be activated after the running tool 28 is disengaged from the liner 24, and fluid is pumped down the work string 26 and exits the tool 40 in high velocity streams directed to towards the surface of the casing 22. The tool 40 is axially translated through the casing 22 to jet and clean the area 32.

The tool 40 will now be described in more detail with reference to FIGS. 2 to 7 of the accompanying drawings. The tool 40 comprises a generally cylindrical body 42 configured for incorporation in a work string formed of drill pipe, and to that end includes appropriate threaded end couplings, a box coupling 44 and a pin coupling 46. The body 42 defines a through bore 48 and the body wall 50 defines four circumferentially spaced ports 52 providing fluid communication between the bore 48 and an annular manifold 54 defined between an undercut 56 on the outer surface of the body wall 50 and an external sleeve 58. The ports 52 are initially isolated from the tool bore 48 by an internal sleeve 60 secured to the body 42 by shear pins 62. As will be described, the sleeve 60 may be translated axially to open the ports 52 by pumping a ball or dart 63 into the running string to land in and occlude the sleeve 60, such that a differential pressure may be generated across the sleeve 60 to shear the pins 62. The dart 63 may be a DAV MX™ dart as supplied by Churchill Drilling Tools.

The external sleeve 58 is retained on the body 42 by upper and lower, or proximal and distal, stabiliser sleeves 64, 66. Each stabiliser sleeve 64, 66 includes two radially extending stabiliser blades 68, 70, 72, 74 on opposite sides of the sleeves 64, 66 and the sleeves 64, 66 are oriented on the body 42 at 90° relative to one another such that, when viewed along the main axis of the tool 76 in the orientation of FIG. 4, the blades 68, 72, 70, 74 are 0°, 90°, 180° and 270°.

The sleeves 64, 58, 66 are located on the tool body 42 from the lower, pin end, which is of slightly smaller diameter than the box end. The upper sleeve 64 abuts a body shoulder 78 and both stabiliser sleeves 64, 66 are also secured by grub screws 80 engaging corresponding recesses 81 in the outer surface of the body 42.

The external sleeve 58 includes an undercut 82 which coincides with the body undercut 56. Grooves 84, 86 are provided in the inner surface of the sleeve 58 above and below the undercut 82 and accommodate seals 88, 90 which engage the outer surface of the body 42.

The sleeve 58 includes four radially extending cleaning blades 92, two proximal or upper blades 92*a*, 92*b* on opposite sides of the sleeve 58 which are axially spaced from two distal or lower blades 92*c*, 92*d* on opposite sides of the sleeve 58 and offset 90° from the upper blades 92*a*, 92*b*. Each blade 92 defines a radially and circumferentially extending jetting slot 94 providing a fluid path between the manifold and the outer surface of the respective blade 92. Each slot 94 acts as a nozzle, in that the slot outlet opening defines a restricted flow area. However, in contrast to a conventional circular nozzle which generates a fluid jet having circular cross section, the long narrow substantially rectangular slots 94 form fluid jets with corresponding long narrow substantially rectangular cross sections.

The stabiliser blades 68, 70, 72, 74 have a marginally greater radial extent than the cleaning blades 92 such that, when located in an inclined or horizontal bore, the stabiliser blades 68, 70, 72, 74 will ensure the cleaning blades 92, and thus the slot outlets 94, remaining clear of the surrounding bore wall. The stabiliser blades 68, 70, 72, 74 will also protect the cleaning blades 92 and slots 94 from damage as the tool is translated through the well.

As noted above the various blades are circumferentially spaced and as such the sleeves define part-annular flutes to facilitate movement of fluid past the exterior of the tool 40: flutes 96 between the stabiliser blades 72, 74 of the lower sleeve 66 are aligned with flutes 98 between the lower cleaning blades 92*c*, 92*d*, while flutes 100 between the upper cleaning blades 92*a*, 92*b* are aligned with flutes 102 between the stabiliser blades 68, 70 of the upper sleeve 64. The lower flutes 96, 98 are offset from the upper flutes 100, 102 by 90° and the axial spacing between the upper cleaning blades 92*a*, 92*b* and the lower cleaning blades 92*c*, 92*d* provides a circumferential flute 99 which accommodates the diversion of flowing fluid between the offset axial flutes.

In use, the tool 40 is incorporated in the lower or distal end of the work string 26 as illustrated in FIG. 1. The tool 40 is initially provided in a dormant configuration, that is with the internal sleeve 60 isolating the ports 52 from the fluid in the string/body bore 48. As the tool 40 is translated through the fluid-filled casing 22, well fluid may flow externally past the tool 40 via the flutes 96, 98, 99, 100, 102. Once the liner 24 has been installed and the running tool 28 disengaged from the upper or proximal end of the liner 24, the work string 26 is retrieved to locate the cleaning tool 40 adjacent the sealing area 32. If the work string 26 is filled with drilling fluid/mud the operator may choose to circulate out the mud by pumping in "clean" brine, that is brine carrying little if any particulates, to minimise the possibility of blocking the jetting slots 94.

A dart 63 is then inserted into the string 26 at surface and is pumped down the string 26 to land on the internal sleeve 60. The inertia of the dart 63 and the following liquid may provide enough force to shear the pins 62 and allow the sleeve 60 to be translated downwards to open the ports 52. Alternatively, landing the dart 63 in the sleeve 60 occludes the bore 48 such that continued pumping creates a pressure differential across the sleeve 60 high enough generate an axial force on the sleeve 60 sufficient to shear the pins 62. The dart 63 and sleeve 60 move downwards through the bore 48 to a catcher or stop from where the dart 63 and sleeve 60 may be retrieved when the tool 40 is disassembled.

The displaced sleeve 60 and dart 63 substantially occlude the tool bore 48 such that all the fluid being pumped down the string 26 is now redirected through the ports 52, into the manifold 54, and then out of the slots 94. The slots 94 are narrow and define a restricted flow area such that the fluid is accelerated and leaves the slots 94 at high velocity, typically more than 50 feet/second (15 m/s). Each slot 94 generates a high velocity continuous line of spray at 90° to the tool axis 76, with each line of spray extending continuously approximately one quarter or 90° around the circumference of the tool 40. Viewed along the tool axis 76, the circumferential offset between the four slots 94 results in the lines of spray collectively providing a complete 360° spray line coverage. Thus, to obtain complete 360° cleaning of the area 32 it only necessary to translate the tool 40 axially. In other words, there is no requirement to rotate the string 26.

The high velocity fluid jet impacts the inner wall of the casing 22 and is effective in dislodging material from the surface. As the outer faces of the cleaning blades 92 and the slot openings are close to the casing surface, there is minimal loss of fluid velocity before the fluid exiting the slots 94 strikes or impacts the casing surface. The fluid is then forced to flow away from the impact zone in a substantially axial direction through the narrow annular gap between the casing and the respective blade surface. Given the restricted flow area provided by the narrow gap, the speed of the fluid remains high. Further, the flow in the gap is turbulent, providing an effective cleaning action for dislodging material from the casing surface as the fluid flows over the outer surface of the blade 92.

The tool 40 may be operated only as long as is required to clean the area 32, or the tool 40 may be operated substantially continuously as the work string 26 is retrieved, such that all or at least a major portion of the casing 22 is subject to cleaning. If desired, the tool 40 may also be utilised to clean surface apparatus, and in an offshore well may be utilised to continue cleaning as the tool 40 is translated through seabed-mounted apparatus, such as a blowout preventer stack.

The tool 40 thus allows for relatively quick and efficient cleaning of the sealing area 32, without the requirement for a separate run, as would be the case if a conventional mechanical scraper were used. The operation of the tool 40 does not require the provision of any specialised apparatus, and effective cleaning jets may be provided by using conventional surface pumps.

It will be apparent to the skilled person that a cleaning tool in accordance with this disclosure may take other forms. For example, the four jetting slots 94 the above-described example each extend part-circumferentially (90°) around the tool body. In other examples a lesser or greater number of slots could be provided, the slots could overlap, or the slots might not necessarily provide complete circumferential (360°) coverage. For example, three axially spaced sets of two 60° slots could be provided. Further, in other examples the slots could extend axially or be inclined, for example the slots could extend helically around the body, or a combination of different slot configurations could be provided in a single tool. In some of these configurations it may be necessary to rotate the tool, or to rotate and reciprocate the tool to achieve complete coverage of an area of the bore wall.

In the illustrated example the cleaning blades and the stabiliser blades are provided separately, however in other examples the stabilisers could be combined. For example, a single stabiliser could be provided with a stepped outer face, with a jetting slot provided in a smaller diameter portion.

Reference is now made to FIGS. 8 to 12 of the drawings, which illustrate an alternative cleaning tool 140 in accordance with an aspect of the disclosure. The tool 140 shares technical and operational features with the tool 40 described above, and in the interest of brevity common features may not be described again in detail.

The tool 140 comprises a generally cylindrical body 142 defining a through bore 148 and the body wall 150 defines four fluid ports 152*a*, 152*b*, 152*c* (fourth port not visible in Figures). As will be described, the upper or proximal ports 152*a*, 152*b* may be configured to provide fluid communication with respective upper or proximal jetting slots 194*a*, 194*b*, and the lower or distal ports 152*c* may be configured to provide fluid communication with respective lower or distal jetting slots 194*c*, 194*d*. The proximal ports 152*a*, 152*b* are in communication with a circumferential groove 153*a* in the outer surface of the body wall 150, the groove 153*a* acting as a manifold and providing fluid communication between the ports 152*a*, 152*b* and the slots 194*a*, 194*b*. A similar groove 153*b* provides fluid communication between the distal ports 152*c* and the distal slots 194*c*, 194*d*. The ports 152 are initially isolated from the tool bore 148 by an internal sleeve 160 secured to the body 142 by shear pins 162. As will be described, the sleeve 160 may be translated axially to open the ports 152 by pumping a dart 163 (FIG. 11) into the associated running string to land in and partially occlude the sleeve 160, such that a differential pressure may be generated across the sleeve 160 to shear the retaining pins 162.

Upper and lower, or proximal and distal, stabiliser sleeves 164, 166 are mounted on the tool body 142; the sleeves 164, 166 are identical but, as will be described, are located at different orientations on the body 142. Each stabiliser sleeve 164, 166 includes two radially and axially extending stabiliser blades 168, 170, 172, 174 on opposite sides of the sleeves 164, 166. The sleeves 164, 166 are oriented on the body 142 at 90° relative to one another such that, when viewed along the main axis of the tool 176 in the orientation of FIG. 8, the blades 168, 172, 170, 174 are at 0°, 90°, 180° and 270°. The sleeves 164, 166 are secured on the body 142 by grub screws 180 engaging corresponding recesses 181 in the outer surface of the body 142.

The proximal sleeve 164 includes two radially and axially extending upper or proximal cleaning blades 192*a*, 192*b* on opposite sides of the sleeve 164 which are aligned with and continuous with the respective proximal stabiliser blades 168, 170. The distal sleeve 166 similarly includes two distal or lower cleaning blades 192*c*, 192*d* on opposite sides of the sleeve 166, offset 90° from the upper blades 192*a*, 192*b*, and aligned with and continuous with the respective distal stabiliser blades 172, 174.

Each cleaning blade 192 defines a radially and circumferentially extending jetting slot 194*a*, 194*b*, 194*c*, 194*d* providing a fluid path between a respective fluid port 152*a*, 152*b*, 152*c* and the outer surface of the respective blade 192. Each slot 194 acts as a nozzle, in that the slot outlet opening defines a restricted flow area. Further, each slot 194 has a length equal to one quarter of the circumference described by the cleaning blades.

Figure 11:
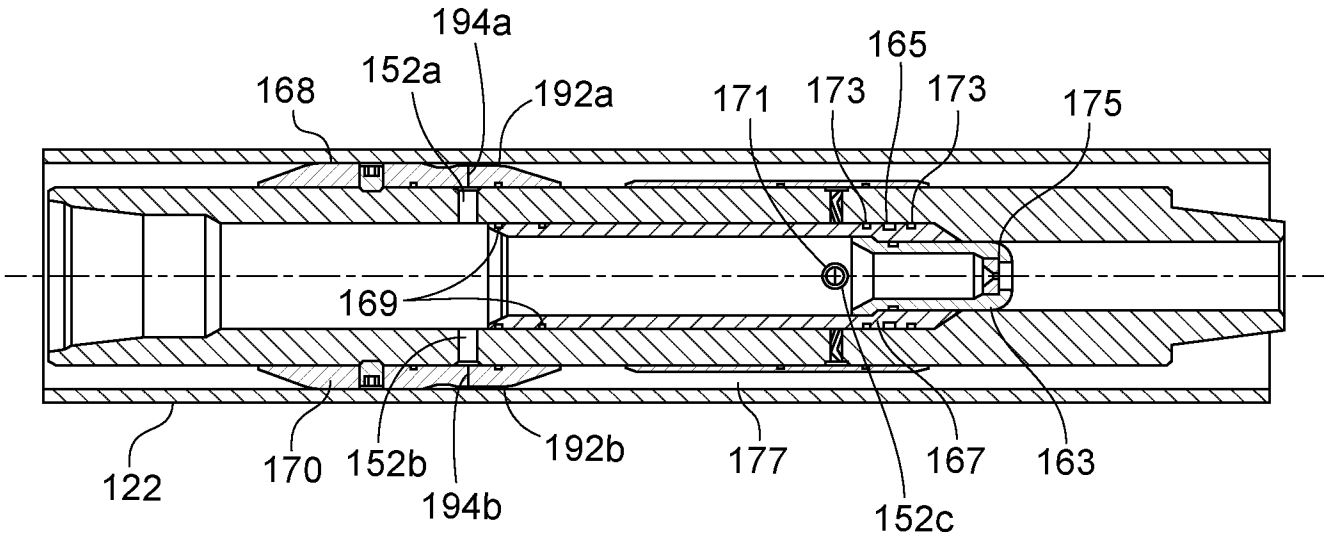
FIG. 11 is a sectional view of the cleaning tool of FIG. 8, in an active or open configuration, and located within a section of casing.
Figure 12:
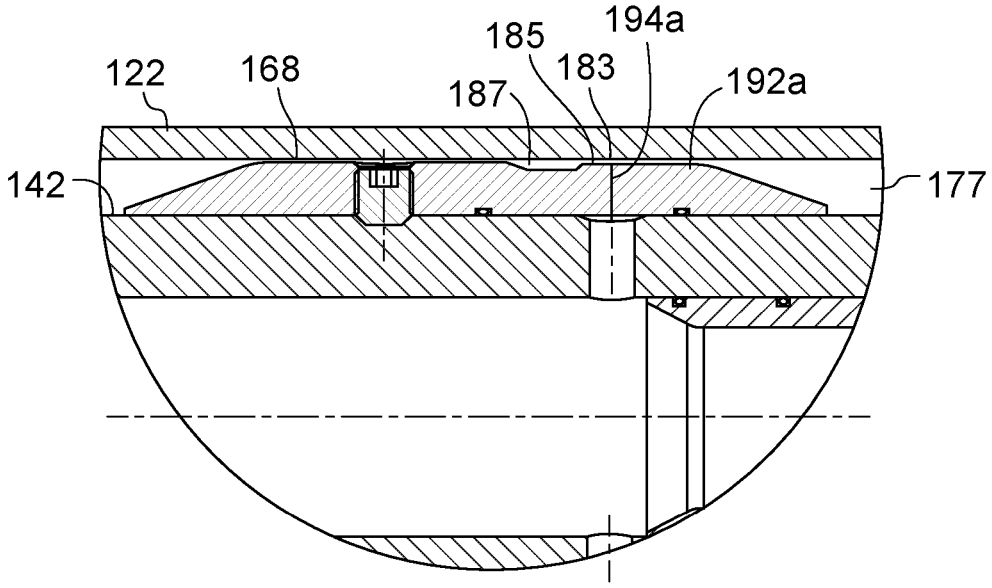
FIG. 12 is an enlarged sectional view of a detail of FIG. 11.

The stabiliser blades 168, 170, 172, 174 have a marginally greater radial extent than the cleaning blades 192 such that, when located in an inclined or horizontal bore, the stabiliser blades 168, 170, 172, 174 will ensure the cleaning blades 192, and thus the slot outlets 194, remain clear of the surrounding bore wall, as is evident in FIGS. 11 and 12.

The various blades are circumferentially spaced and as such the sleeves define part-annular axially extending flutes to facilitate movement of fluid past the exterior of the tool 140: flutes 196 extend between the stabiliser blades 172, 174 and the cleaning blades 192*c*, 192*d* of the lower sleeve 166, while flutes 198 extend between the upper cleaning blades 192*a*, 192*b* and the aligned stabiliser blades 168, 170 of the upper sleeve 164. The lower flutes 196 are offset from the upper flutes 198 by 90°. The axial spacing between the upper cleaning blades 192*a*, 192*b* and the lower stabiliser blades 172, 174, and thus the provision of a circumferentially extending flute 199 between the sleeves 164, 166, links the axially extending flutes 196, 198 and accommodates the circumferential diversion of flowing fluid between the offset flutes 196, 198.

Figure 9:
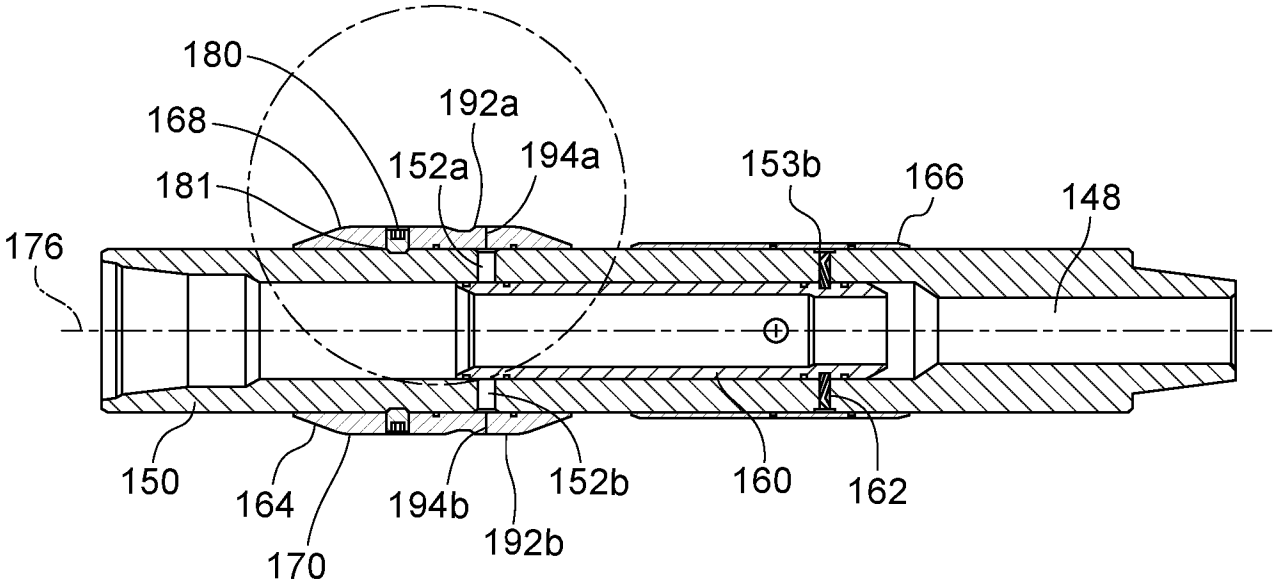
FIG. 9 is a sectional view of the cleaning tool of FIG. 8, in a dormant or closed configuration.
Figure 10:
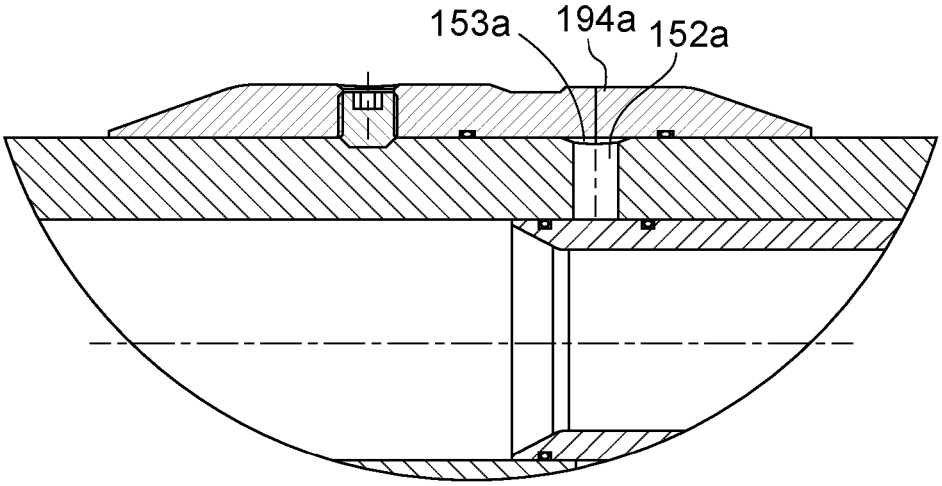
FIG. 10 is an enlarged sectional view of detail 10 of FIG. 9.

In use, the tool 140 is incorporated in the lower or distal end of a work string, like the tool 40 as illustrated in FIG. 1. The tool 140 is initially provided in a dormant configuration, with the sleeve 160 isolating the ports 152 from the fluid in the string/body bore 148, as illustrated in FIGS. 9 and 10. To activate the tool 140, a dart 163 (FIG. 11) is inserted into the string at surface and is pumped down the string to land a dart profile 165 on a shoulder 167 towards a distal end of the sleeve 160. The inertia of the dart 163 and the following column of liquid will typically provide enough force to shear the pins 162 and allow the sleeve 160 to be translated downwards to open the ports 152. The downwards movement of the sleeve 160 is limited by the leading end of the sleeve 160 engaging a shoulder in the body bore 148. Translation of the sleeve 160 moves the upper or proximal end of the sleeve below the proximal ports 152*a*, 152*b*, which were previously isolated from body bore 148 by seals 169 on the outer surface of the sleeve 160. Translation of the sleeve 160 further moves ports 171 in the sleeve 160 into alignment with the distal ports 152*c*, which were previously isolated from the body bore 148 by seals 173 on the outer surface of the sleeve 160.

The displaced sleeve 160 and dart 163 substantially occlude the tool bore 148 such that most of the fluid being pumped down the string and into the tool 140 is now redirected through the ports 152 and out of the respective slots 194.

In this example a proportion of the fluid being pumped down the string and into the tool 140 passes through a nozzle 175 provided in the dart 163 and flows to the end of the work string, before flowing back towards surface through the annulus 177 between the string and the surrounding casing 122. The flow of fluid in the annulus 177 assists in clearing and entraining the material that is being dislodged from the surface of the casing 122 by the jets of fluid being directed out of the slots 194.

In this example the slots 194 are 0.5 mm wide (in other examples the slots may be up to 1 mm wide) and define a restricted flow area such that the fluid is accelerated and leaves the slots 194 at high velocity. Of course, the dimensions of the tool 140 may be determined by the skilled person to suit the intended application of the tool 140. However, by way of example, the tool 140 may be intended for use in cleaning 9-⅝" (24.45 cm) 47 lb/ft (70 kg/m) casing/liner 122, which has an internal diameter of 8.681" (22.05 cm). For such an application the stabiliser blades 168, 170, 172, 174 may describe an outer diameter of 8.50" (21.59 cm) while the slightly smaller cleaning blades 192 describe an outer diameter of 8.40" (21.34 cm). Thus, there will be a 0.28" (0.71 cm) diametrical gap between the cleaning blades 192, and the outlets of the slots 194, and the casing 122. If the tool 140 was resting on the casing 122 on the low side of an inclined or horizontal bore, the outlet of a slot 194 on the lower side of the tool 140 would be spaced 0.05" (0.127 cm) from the casing 122, while a slot 194 on the upper side of the tool 140 would be spaced 0.24" (0.601 cm) from the casing 122. This spacing is close enough for the high velocity of the fluid jet to be maintained until the fluid impacts on the casing 122, but not so close that the fluid would be likely to erode or damage the surface of the casing.

Given that the slots 194 are 0.5 mm wide and the total length of the four slot outlets 194*a-d* is 26.39" (67.04 cm), with each slot 194 having a length of 6.6" (16.76 cm), the total flow area of the slot outlets will be 106.7 $mm^2$. This provides a total flow area (TFA) which facilitates provision of high jet velocities.

The cleaning fluid exits the slots 194 as four high velocity jets at right angles to the tool axis 176, and the proximity of the slot outlets to the casing 122 ensures that the high velocity is substantially maintained, and the fluid strikes the casing at high velocity. The fluid is then deflected by the casing surface and flows away from the impact zone 183, as turbulent flow, through the narrow annular gap 185 between the outer surface of the respective cleaning blade and the casing 122. The narrowness of the gap 185 ensures that the fluid continues to flow quickly, providing for further surface cleaning. To facilitate the movement of dislodged material towards the surface and out of the well, it is preferred that the fluid flows upwards through the gap 185 from the impact zone 183, and this is encouraged by the provision of a circumferential groove 187 between the proximal end of the cleaning blade and the distal end of the stabiliser blade, through which the fluid, and any entrained material, may flow into the flutes 196, 198.

Figure 13:
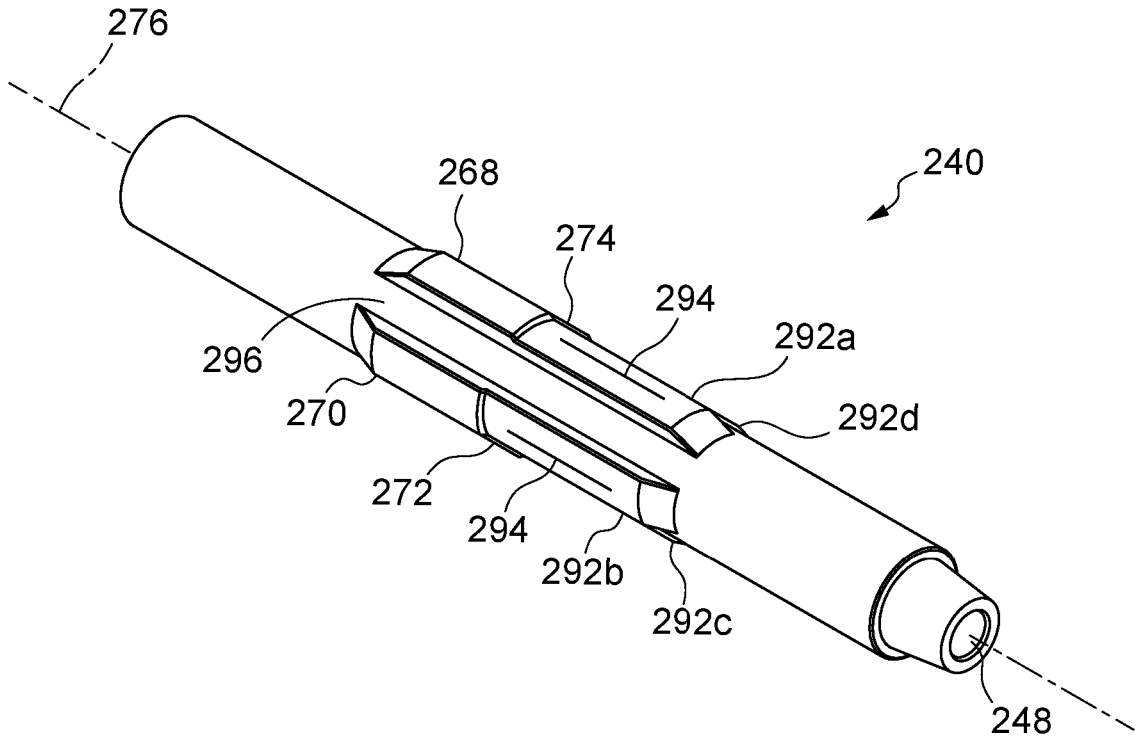
FIG. 13 is an isometric view of a further alternative cleaning tool in accordance with an aspect of the disclosure.

Reference is now made to FIG. 13 of the drawings, which is an isometric view of a further alternative cleaning tool 240 in accordance with an aspect of the disclosure. The operation of the tool 240 is generally similar to the tools 40, 140 described above, however the configuration of the stabiliser and cleaning blades, and the jetting slots, is different, and the description below will focus on these features.

The tool 240 has four radially extending stabiliser blades 268, 270, 272, 274. The stabiliser blades are at the same axial location on the tool body 242, are axially oriented, and at 90° spacings. The tool 240 is further provided with four radially extending cleaning blades 292*a*, 292*b*, 292*c*, 292*d*. Each cleaning blade is continuous and axially aligned with a respective stabiliser blade. The cleaning blades 292*a*, 292*b*, 292*c*, 292*d* are located below or distally of the stabiliser blades 268, 270, 272, 274. Each cleaning blade 292 defines a radially and axially extending jetting slot 294 providing a fluid path between the tool body bore 248 and the outer surface of the respective blade 292. As with the other tools described above, each elongated slot 294 acts as a nozzle and forms a fluid jet with a corresponding long narrow substantially rectangular cross section.

The stabiliser blades 268, 270, 272, 274 have a marginally greater radial extent than the cleaning blades 292 such that, when located in an inclined or horizontal bore, the stabiliser blades 268, 270, 272, 274 will ensure the cleaning blades 292, and thus the slot outlets 294, remaining clear of the surrounding bore wall.

The composite blades are circumferentially spaced and define axially extending part-annular flutes 296 therebetween to facilitate movement of fluid past the exterior of the tool 240.

The operation and use of the tool is similar to the tools 40, 140 described above, however once activated the tool 240 provides four high velocity continuous lines of spray parallel to the tool axis 276. Thus, to obtain complete 360° cleaning of an area of surrounding tubing it is necessary to rotate the tool 240.

REFERENCE NUMERALS well 10
surface 12
earth 14
hydrocarbon-bearing formation 16
vertical section 18
horizontal section 20
casing 22
slotted liner 24
work string 26
running tool 28
liner hanger 30
sealing area 32
cleaning tool 40
tool body 42
box coupling 44
pin coupling 46
body bore 48
body wall 50
ports 52
annular manifold 54
body undercut 56
external sleeve 58
internal sleeve 60
shear pins 62
dart 63
upper stabiliser sleeve 64
lower stabiliser sleeve 66
stabiliser blades 68, 70, 72, 74
tool axis 76
body shoulder 78
grub screws 80
recesses 81
sleeve undercut 82
seal grooves 84, 86
seals 88, 90
cleaning blades 92
upper cleaning blades 92*a*, 92*b*
lower cleaning blades 92*c*, 92*d*
jetting slots 94
flutes 96, 98, 99, 100, 102
casing 122
cleaning tool 140
tool body 142
body bore 148
body wall 150
fluid ports 152*a*,152*b*,152*c*
circumferential grooves 153*a*, 153*b*
internal sleeve 160
shear pins 162
dart 163
dart profile 165 stabiliser sleeves 164,166
shoulder 167
sleeve seals 169
sleeve ports 171
sleeve seals 173
dart nozzle 175
stabiliser blades 168,170,172,174
tool axis 176
annulus 177
grub screws 180
recesses 181
impact zone 183
annular gap 185
circumferential groove 187
cleaning blades 192*a*,192*b*,192*c*,192*d*
jetting slots 194*a*,194*b*,194*c*,194*d*
flutes 196,198,199
cleaning tool 240
tool body bore 248
stabiliser blades 268,270,272,274
tool axis 276
cleaning blades 292*a*,292*b*,292*c*,292*d*
jetting slot 294
flutes 296

The invention claimed is:

1. A tool for cleaning a downhole tubing, the tool comprising:

a tubular body defining an internal bore, at least one radially extending blade, and an external axially extending bypass flute, the tubular body further defining a fluid flow path from the internal bore to at least one elongated jetting slot extending along an outer surface of the blade, whereby when cleaning fluid is pumped through the fluid flow path the at least one elongated jetting slot generates and directs a surface cleaning fluid jet with an elongated cross section from the outer surface of the blade to an impact zone on an opposing surface of the downhole tubing, and wherein the cleaning fluid flows away from the impact zone along the opposing surface of the downhole tubing and through a gap between the outer surface of the blade and the opposing surface of the downhole tubing.

2. The tool of claim 1, wherein the at least one elongated jetting slot is provided in a first blade with a first radial extent and the tubular body further defines a second blade with a second radial extent greater than the first radial extent.

3. The tool of claim 2, wherein the first blade is axially spaced from the second blade.

4. The tool of claim 1, wherein the at least one elongated jetting slot extends circumferentially around the tubular body.

5. The tool of claim 1, comprising a plurality of jetting slots.

6. The tool of claim 1, comprising a plurality of jetting slots, and wherein each jetting slot is associated with a respective blade.

7. The tool of claim 1, comprising a plurality of jetting slots, each jetting slot extending part circumferentially around the tubular body, and wherein the slots collectively provide full circumferential coverage around the tubular body.

8. The tool of claim 1, comprising a plurality of bypass flutes.

9. The tool of claim 1, including a valve having a first configuration in which the fluid flow path is closed and a second configuration in which the fluid flow path is open.

10. The tool of claim 1, wherein the fluid flow path comprises flow ports in the tubular body in communication with the internal bore.

11. The tool of claim 10, wherein an internal sleeve initially closes the flow ports and axial displacement of the internal sleeve opens the flow ports.

12. The tool of claim 1, comprising a flow restriction configured to occlude the internal bore at least partially such that fluid passing into the tool is directed along the fluid flow path and out of the at least one elongated jetting slot.

13. The tool of claim 1, wherein the tubular body comprises a primary body member and an external sleeve, and the blade and the at least one elongated jetting slot are formed by the external sleeve.

14. The tool of claim 13, further comprising a manifold disposed between the primary body member and the external sleeve, the manifold providing fluid communication between a plurality of flow ports in the primary body member and a plurality of spaced jetting slots formed in the external sleeve.

* * * * *